US006291418B1

(12) United States Patent
Mertens et al.

(10) Patent No.: US 6,291,418 B1
(45) Date of Patent: Sep. 18, 2001

(54) MICROEMULSION LIQUID CLEANING COMPOSITION CONTAINING A SHORT CHAIN AMPHIPHILE

(75) Inventors: Baudouin Mertens, Jambes; Claude Blanvalet, Angleur; Myriam Mondin, Seraing, all of (BE)

(73) Assignee: Colgate Palmolive Company, New York, NY (US)

( * ) Notice: Subject to any disclaimer, the term of this patent is extended or adjusted under 35 U.S.C. 154(b) by 0 days.

(21) Appl. No.: 09/589,305

(22) Filed: Jun. 7, 2000

Related U.S. Application Data

(63) Continuation-in-part of application No. 09/442,914, filed on Dec. 22, 1999, now Pat. No. 6,136,774, which is a continuation-in-part of application No. 09/419,186, filed on Oct. 15, 1999, now Pat. No. 6,057,279, which is a continuation-in-part of application No. 09/304,159, filed on Apr. 30, 1999, now Pat. No. 6,004,919, which is a continuation-in-part of application No. 09/191,002, filed on Nov. 12, 1998, now Pat. No. 6,136,773.

(51) Int. Cl.[7] ..... C11D 17/00

(52) U.S. Cl. ..... 510/417; 510/352; 510/428; 510/430; 510/437; 510/470; 510/471; 510/473; 510/477; 510/505; 510/508

(58) Field of Search ..... 510/424, 352, 510/428, 430, 437, 470, 417, 471, 473, 477, 505, 508

(56) References Cited

U.S. PATENT DOCUMENTS

| | | | | |
|---|---|---|---|---|
| 5,108,643 | * | 4/1992 | Loth et al. | 252/174.11 |
| 5,294,364 | * | 3/1994 | Thomas et al. | 252/142 |
| 5,554,320 | * | 9/1996 | Yianakopoulos | 252/389.23 |
| 5,968,888 | * | 10/1999 | Blandiaux | 510/396 |

* cited by examiner

*Primary Examiner*—Necholus Ogden
(74) *Attorney, Agent, or Firm*—Richard E. Nanfeldt

(57) ABSTRACT

An improvement is described in thickened all purpose liquid cleaning composition and microemulsion composition which are especially effective in the removal of oily and greasy soil and contains an anionic detergent, an ethoxylated/propoxylated nonionic surfactant, a short chain amphiphile or a water soluble cosurfactant, a polymeric thickener, a hydrocarbon ingredient, and water and optionally, an ethoxylated nonionic surfactant.

9 Claims, No Drawings

MICROEMULSION LIQUID CLEANING COMPOSITION CONTAINING A SHORT CHAIN AMPHIPHILE

RELATED APPLICATIONS

This application is a continuation in part application of U.S. Ser. No. 9/442,914 filed Dec. 22, 1999 now U.S. Pat. No. 6,136,774 which in turn is a continuation in part application of U.S. Ser. No. 9/419,186 filed Oct. 15, 1999 now U.S. Pat. No. 6,057,279 which in turn is a continuation in part application of U.S. Ser. No. 9/304,159 filed Apr. 30, 1999 now U.S. Pat. No. 6,004,919 which in turn is a continuation in part application of U.S. Ser. No. 9/191,002 filed Nov. 12, 1998 now U.S. Pat. No. 6,116,773.

FIELD OF THE INVENTION

The present invention relates to a thickened liquid cleaning microemulsion composition containing short chain amphiphiles.

BACKGROUND OF THE INVENTION

This invention relates to an improved thickened, all-purpose liquid cleaning composition or a microemulsion composition having excellent foam collapse properties and excellent grease cutting properties designed in particular for cleaning vertical hard surfaces and which is effective in removing grease soil and/or bath soil and in leaving unrinsed surfaces with a shiny appearance. The composition is also shear thinning which means that it can be easily removed from the wall without excessive mechanical action.

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. Nos. 4,472,291—Rosario; 4,540,448—Gauteer et al; 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; and U.S. Pat. Nos. 4,414,128 and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

SUMMARY OF THE INVENTION

The present invention provides an improved, thickened liquid cleaning composition having excellent foam collapse properties and excellent grease cutting property in the form of a microemulsion which is suitable for cleaning vertical hard surfaces such as plastic, vitreous and metal surfaces having a shiny finish, oil stained floors, automotive engines and other engines. More particularly, the improved cleaning compositions, with excellent foam collapse properties and excellent grease cutting property exhibit good grease soil removal properties due to the improved interfacial tensions, when used in undiluted (neat) or dilute form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, optically clear microemulsion, hard surface cleaning composition especially effective in the removal of oily and greasy oil, which is in the form of a substantially dilute oil-in-water microemulsion having an aqueous phase and an oil phase. The dilute microemulsion composition includes, on a weight basis:

0.1% to 8% of a sulfonate anionic surfactant;

0 to 7%, more preferably 0.5% to 6% of a nonionic surfactant;

0.25% to 6% of an ethoxylated/propoxylated nonionic surfactant;

0 to 8%, more preferably 0.5% to 6% of a short chain amphiphile;

0 to 10%, more preferably 0.5% to 8% of a water soluble cosurfactant;

0.25% to 6% of magnesium sulfate heptahydrate;

0.05% to 2% of a fatty acid;

0.1% to 3%, more preferably 0.25% to 2% of a polymeric thickener;

0.1% to 5.0% of a perfume, essential oil, or water insoluble hydrocarbon having 6 to 18 carbon atoms; and the balance being water, wherein the composition has a Brookfield (RVT) viscosity of about 200 to 2000 cps at RT using a #3 spindle at 50 rpms and wherein the composition does not contain a composition which is a mixture of a partially esterified ethoxylated polyhydric alcohol, a fully esterified ethoxylated polyhydric alcohol and a nonesterified ethoxylated polyhydric alcohol such compounds being exemplified by Levenol F-200 and Levenol V501/2 both manufactured by KAO Corporation as well as polyesterified nonionic compounds such as Crovol PK-40 and Crovol PK-70 manufactured by Croda GMBH of the Netherlands. Excluded from the instant microemulsion and all purpose cleaning compositions are grease release agents characterized by the formula:

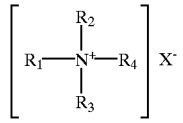

wherein $R_1$ is a methyl group and $R_2$, $R_3$ and $R_4$ are independently selected from the group consisting of methyl, ethyl, and $CH_2CH_2Y$, wherein Y is selected from the group consisting of Cl, Br, $CO_2H$, $(CH_2O)_nOH$ wherein n=1 to 10, OH, $CH_2CH_9OH$ and x is selected from the group consisting of Cl, Br, methosulfate

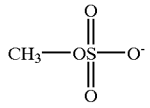

and $_{13}$ $HCO_3^-$

Also excluded from the instant microemulsion or all purpose cleaning compositions are grease release agents which are an ethoxylated maleic anhydride-alpha-olefin copolymer having a comblike structure with both hydrophobic and hydrophilic chains and is depicted by the formula:

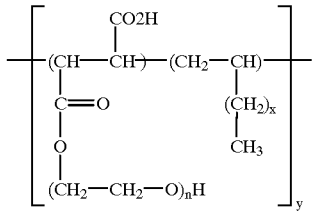

wherein n is about 5 to about 14, preferably about 7 to 9, x is about 7 to 19, preferably 8 to 19 and y is of such a value as to provide a molecular weight about 10,000 to about 30,000.

DETAILED DESCRIPTION OF THE INVENTION

The present invention relates to a stable optically clear microemulsion composition comprising approximately by weight: 0.1% to 8% of a sulfonate anionic surfactant, 0.05% to 2% of a fatty acid; 0 to 8%, more preferably 0.5% to 6% of a short chain amphiphile; 0 to 10%, more preferably 0.5% to 8% of a water soluble cosurfactant, 0.25% to 6% of magnesium sulfate heptahydrate; 0 to 7%, more preferably 0.5% to 6% of an ethoxylated nonionic surfactant, 0.25% to 6% of an ethoxylated/propoxylated nonionic surfactant; 0.1% to 3%, more preferably 0.25% to 2% of a polymeric thickener, 0.1% to 5% of a water insoluble hydrocarbon, essential oil or a perfume, and the balance being water.

According to the present invention, the role of the water insoluble hydrocarbon can be provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble. Therefore, by incorporating the perfume into the aqueous cleaning composition as the oil (hydrocarbon) phase of the ultimate o/w microemulsion composition, several different important advantages are achieved.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc,. The instant compositions show a marked improvement in ecotoxocity as compared to existing commercial products.

The hydrocarbon such as a perfume is present in the dilute o/w microemulsion in an amount of from 0.1% to 5% by weight, preferably from 0.4% to 5% by weight. If the amount of hydrocarbon (perfume) is less than 0.4% by weight it becomes difficult to form the o/w microemulsion. If the hydrocarbon (perfume) is added in amounts more than 10% by weight, the cost is increased without any additional cleaning benefit and, in fact, with some diminishing of cleaning performance insofar as the total amount of greasy or oily soil which can be taken up in the oil phase of the microemulsion will decrease proportionately.

In place of the perfume in either the microemulsion composition or the all purpose hard surface cleaning composition at the same previously defined concentrations that the perfume was used in either the microemulsion or the all purpose hard surface cleaning composition one can employ an essential oil or a water insoluble hydrocarbon having 6 to 18 carbon such as a paraffin or isoparaffin.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen.

Suitable water-soluble non-soap, anionic surfactants include those surface-active or detergent compounds which contain an organic hydrophobic group containing generally 8 to 26 carbon atoms and preferably 10 to 18 carbon atoms in their molecular structure and at least one water-solubilizing group which is sulfonate group, so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

One preferred sulfonate surfactant is a linear alkyl benzene sulfonate having a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other example of operative anionic surfactants includes sodium dioctyl sulfosuccinate [di-(2 ethylhexyl) sodium sulfosuccinate being one ] and corresponding dihexyl and dioctyl esters. The preferred sulfosuccinic acid ester salts are esters of aliphitic alcohols such as saturated alkanols of 4 to 12 carbon atoms and are normally diesters of such alkanols. More preferably such are alkali metal salts of the diesters of alcohols of 6 to 10 carbons atoms and more preferably the diesters will be from octanol, such as 2-ethyl hexanol, and the sulfonic acid salt will be the sodium salt.

Especially preferred anionic sulfonate surfactants are paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735, 096.

Of the foregoing non-soap anionic sulfonate surfactants, the preferred surfactants are the magnesium salt of the $C_{13}$–$C_{17}$ paraffin or alkane sulfonates.

Generally, the proportion of the nonsoap-anionic surfactant will be in the range of 0.1% to 8%, preferably from 1% to 6%, by weight of the dilute microemulsion composition.

The instant composition contains about 0 to 7 wt. %, more preferably 0.5 wt. % to 6 wt. % of an ethoxylated nonionic surfactant.

The water soluble aliphatic ethoxylated nonionic surfactants utilized in this invention are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class includes the condensation products of a higher alcohol (e.g., an alkanol containing about 8 to 16 carbon atoms in a straight or ranched chain configuration) condensed with about 4 to 20 moles of ethylene oxide, or example, lauryl or myristyl alcohol condensed with about 16 moles of ethylene oxide (EO), tridecanol condensed with about 6 to 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 4 to 10 moles of ethylene oxide (Neodol 91-8 or Neodol 91-5), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 7 contain less than 4 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

The water soluble ethoxylated/propoxylated nonionic surfactants which can be utilized in this invention are an aliphatic ethoxylated/propoxylated nonionic surfactants which are depicted by the formula:

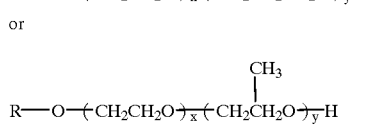

wherein R is a branched chain alkyl group having about 10 to about 16 carbon atoms, preferably an isotridecyl group and x and y are independently numbered from 1 to 20. A preferred ethoxylated/propoxylated nonionic surfactant is Plurafac® 300 manufactured by BASF.

The composition contains 0 to 8 wt. %, more preferably 0.5 wt. % to 6 wt. % of a short chain amphiphile which is characterized by the formula:

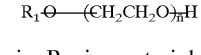

wherein $R_1$ is a straight or branched chain alkyl group having 5 to 8 carbon atoms and n is a number from 2 to 8, more preferably 5 to 6 and the amphiphile has an HLB of about 6 to about 9, preferably about 7 to about 8. Preferred amphiphiles have a $C_6$ alkyl group and 2 to 5 EO such as hexanol 5EO.

The water soluble cosurfactant which can be used in place of the short chain amphiphile can play an essential role in the formation of the the liquid crystal composition or dilute o/w microemulsion and the concentrated microemulsion compositions. Suitable cosurfactants for the microemulsion over temperature ranges extending from 5° C. to 43° C. are water-soluble $C_3$–$C_4$ alkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_n$ OH and $R_1(X)_nOH$ wherein R is $C_1$–$C_6$ alkyl, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol propionate.

The polymeric thickener is selected from the group consisting of an alkyl hydroxy celluloses and polyacrylates. Preferred thickener is Natrosol HHBR 250 which is hydroxy ethyl cellulose sold by Hercules Chemical Co and which has a average molecular weight of 1500000. Another preferred thickener is Acusol 820 which is an associative polyacrylate thickener sold by Rohm & Haas and which has a molecular weight of 800000 to 1000000 and which is hydrophobically modified with C18 side chains. These thickeners provide compositions which are shear thinning, which means that they can be easily removed from the surface being cleaned without much mechanical action. Other thickeners, such as hydroxypropyl cellulose, polyacrylamide or poly vinyl alcohol, would create shear thickening compositions.

The composition also contains an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system, the nature of the primary surfactants and amphiphiles, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of paraffin sulfonate, alkylbenzene sulfonate, etc., while for each gram-ion of $Al^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic surfactant. At higher concentrations of anionic surfactant, the amount of multivalent salt will be in range of 0.5 to 1 equivalents per equivalent of anionic surfactant.

The microemulsion compositions can include from about 0.05% to about 2.0% by weight of the composition of a $C_8$–$C_{22}$ fatty acid or fatty acid soap as a foam suppressant.

The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 2.5 wt. % of a fatty acid is used in the instant compositions, the composition will become unstable at low temperatures as well as having an objectionable smell.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The final essential ingredient in the inventive microemulsion compositions or all purpose hard surface cleaning compositions having improved interfacial tension properties is water. The proportion of water in the microemulsion or all purpose hard surface cleaning composition compositions generally is in the range of 20% to 97%, preferably 70% to 97% by weight.

The liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the microemulsions exhibit stability at reduced and increased temperatures. More specifically, such compositions remain clear and stable in the range of 4° C. to 50° C., especially 2° C. to 43° C. Such compositions exhibit a pH in the acid or neutral range depending on intended end use. The liquids are readily pourable and exhibit a viscosity in the range of 10 to 2000 cps as measured at 25° C. with a Brookfield RVT Viscometer using a #3 spindle rotating at 50 RPM.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the surfactants and amphiphiles can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient. However, it is desirable for the thickener to be first mixed with the water.

The instant microemulsion formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing at 25° C.:

| | Ref. | A | B | C | D | E | F | G | H |
|---|---|---|---|---|---|---|---|---|---|
| Sodium $C_{13}$–$C_{17}$ paraffin sulfonate | 3.36 | 3.36 | 3.36 | 1.8 | 1.8 | 1.8 | 1.8 | 1.8 | 1.8 |
| Levenol F-200 | 0.9 | 0.9 | 0.9 | 0 | 0 | 0 | 0 | 0 | 0 |
| LF300 | 0.9 | 0.9 | 0.9 | 1.2 | 1.2 | 1.2 | 1.2 | 1.2 | 1.2 |
| Dobanol 91-8 | 0 | 0 | 0 | 2.4 | 2.4 | 2.4 | 2.4 | 2.4 | 2.4 |
| Diethylene glycol monobutyl ether | 4.8 | 4.8 | 4.8 | 0 | 0 | 0 | 0 | 0 | 0 |
| Hexanol 5EO | 0 | 0 | 0 | 1.2 | 1.2 | 1.2 | 0 | 0 | 0 |
| Hexanol 3EO | 0 | 0 | 0 | 0 | 0 | 0 | 1.2 | 1.2 | 1.2 |
| Coconut fatty acid | 0.45 | 0.45 | 0.45 | 0.225 | 0.225 | 0.225 | 0.225 | 0.225 | 0.225 |
| Caustic soda (50% wt./wt.) | 0.04 | 0.04 | 0.04 | 0.01 | 0.01 | 0.01 | 0.01 | 0.01 | 0.01 |
| MgSO4 7 H2O | 0.9 | 0.9 | 0.9 | 1 | 1 | 0.75 | 1 | 1 | 0.5 |
| Perfume (a) | 0.8 | 0.8 | 0.8 | 0.8 | 0.8 | 0.8 | 0.8 | 0.8 | 0.8 |
| Acusol 460NK (25% Al0 | 0 | 0 | 0 | 0.5 | 0.5 | 0.5 | 0.5 | 0.5 | 0.5 |
| Acusol 820 (30% Al) | 0 | 3 | 0 | 0 | 3 | 0 | 0 | 3 | 0 |
| Natrosol HHBR 250 (powder) | 0 | 0 | 0.5 | 0 | 0 | 0.5 | 0 | 0 | 0.5 |
| Water | Bal. | Bal. | Bal. | Bal. | Bal. | Bal. | Bal. | Bal. | Bal. |
| Viscosity kinematic 'Raymond #2' (second)[1] | 3 | 11 | 63 | 3 | 19 | 47 | 3 | 29 | 50 |
| Rheological profile[2] | std | shear thinning | shear thinning | | shear thinning | shear thinning | Equal | shear thinning | shear thinning |
| Grease cutting | std | equal | n.a. | equal | sl. worse | n.a. | Equal | sl. worse | n.a. |
| Dilute conditions | | | | | | | | | |
| Less residue | std | better | n.a. | equal | sl. worse | n.a. | equal | sl. better | n.a. |

[1]Measurement of the apparent viscosity: the higher the value, the higher the apparent and kinetic viscosity
[2]Measurement of rheological behavior

What is claimed:

1. A microemulsion cleaning composition comprising approximately by weight:

(a) 0.1 wt. % to 8% of an anionic selected from the group consisting of sulfonated surfactants and sulfated surfactants;

(b) 0.25% to 6% of an ethoxylated/propoxylated nonionic surfactant;

(c) 0.5% to 6% of a short chain amphiphiles formed from the condensation product of an alkanol, and ethylene oxide wherein said short chain amphiphile has the formula:

$$R_1O\ (CH_2CH_2O)_nH$$

wherein $R_1$ is a straight or branched chain alkyl group having 5 to 8 carbon atoms and n is a number from 2 to 8;

(d) 0.05% to 2% of a fatty acid;

(e) 0.25% to 6% of magnesium sulfate;

(f) 0.1 to 5% of a water insoluble hydrocarbon, essential oil or a perfume;

(g) 0.1% to 3% of a polymeric thickener selected from the group consisting of hydroxyethyl cellulose and an associative polyacrylate thickener hydrophobically modified with a $C_{18}$ side chain and having a molecular weight of 800,000 to 1,000,000; and (h) the balance being water, said composition being shear thinning and the composition does not contain a compound instant microemulsion and all purpose cleaning compositions are grease release characterized by formula:

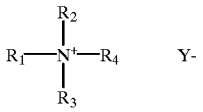

wherein $R_1$ is a methyl group and $R_2$, $R_3$ and $R_4$ are independently selected from the group consisting of methyl, ethyl, and $CH_2CH_2Y$, wherein Y is selected from the group consisting of Cl, Br, $CO_2H$, $(CH_2O)_nOH$ wherein n=1 to 10, OH, $CH_2CH_9OH$ and x is selected from the group consisting of Cl, Br, methosulfate

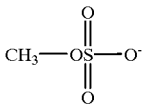

and $HCO_3^{31}$ .

2. The cleaning composition of claim 1 wherein the anionic surfactant is a $C_{13}$–$C_{17}$ paraffin sulfonate or a $C_{10}$–$C_{20}$ alkane sulfonate.

3. The cleaning composition of claim 1, wherein the concentration of the water insoluble hydrocarbon, essential oil or perfume is about 0.4 wt. % to about 5 wt. %.

4. The composition according to claim 3, wherein $R_1$ has 6 carbon atoms and n is a number from 3to 6.

5. The composition according to claim 1 further including an ethoxylated nonionic surfactant.

6. A microemulsion cleaning composition comprising approximately by weight:

(a) 0.1 wt. % to 8% of an anionic selected from the group consisting of sulfonated surfactants and sulfated surfactants;

(b) 0.25% to 6% of an ethoxylated/propoxylated nonionic surfactant;

(c) 0.5% to 8% of a water soluble cosurfactant;

(d) 0.05% to 2% of a fatty acid;

(e) 0.25% to 6% of magnesium sulfate;

(f) 0.1 to 5% to of a water insoluble hydrocarbon, essential oil or a perfume;

(g) 0.1% to 3% of a polymeric thickener; and (h) the balance being water, said composition being shear thinning and the composition does not contain a compound instant microemulsion and all purpose cleaning compositions are grease release characterized by formula:

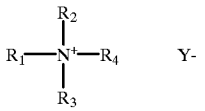

wherein $R_1$ is a methyl group and $R_2$, $R_3$ and $R_4$ are independently selected from the group consisting of methyl, ethyl, and $CH_2CH_2Y$, wherein Y is selected from the group consisting of Cl, Br, $CO_2H$, $(CH_2O)_nOH$ wherein n=1 to 10, OH, $CH_2CH_9OH$ and x is selected from the group consisting of Cl, Br, methosulfate

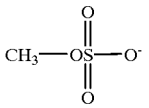

and $HCO_3^{31}$.

7. The cleaning composition of claim 6 wherein the anionic surfactant is a $C_{13}$–$C_{17}$ paraffin sulfonate or a $C_{10}$–$C_{20}$ alkane sulfonate.

8. The cleaning composition of claim 6, wherein the concentration of the water insoluble hydrocarbon, essential oil or perfume is about 0.4 wt. % to about 5 wt. %.

9. The composition according to claim 6 further including an ethoxylated nonionic surfactant.

* * * * *